US009930956B2

(12) United States Patent
Dannan et al.

(10) Patent No.: US 9,930,956 B2
(45) Date of Patent: Apr. 3, 2018

(54) PORTABLE RADIO RETENTION DEVICE

(71) Applicants: Dominic Anthony Dannan, Huntington Beach, CA (US); Robert Puertas, Irvine, CA (US)

(72) Inventors: Dominic Anthony Dannan, Huntington Beach, CA (US); Robert Puertas, Irvine, CA (US)

( * ) Notice: Subject to any disclaimer, the term of this patent is extended or adjusted under 35 U.S.C. 154(b) by 0 days.

(21) Appl. No.: 14/204,109

(22) Filed: Mar. 11, 2014

(65) Prior Publication Data

US 2015/0014376 A1 Jan. 15, 2015

Related U.S. Application Data

(60) Provisional application No. 61/800,339, filed on Mar. 15, 2013.

(51) Int. Cl.
*A45F 5/00* (2006.01)
*A45F 5/02* (2006.01)

(52) U.S. Cl.
CPC ..... *A45F 5/021* (2013.01); *A45F 2200/0508* (2013.01); *A45F 2200/0516* (2013.01); *A45F 2200/0525* (2013.01)

(58) Field of Classification Search
CPC .. Y10S 224/93; A45F 5/021; A45F 2005/006; A45F 2200/0525; A45F 2200/0516; A45F 2200/0508; A45F 5/02
USPC ..... 224/271, 242, 250, 254; 24/3.13
See application file for complete search history.

(56) References Cited

U.S. PATENT DOCUMENTS

| | | | | |
|---|---|---|---|---|
| 5,730,340 | A * | 3/1998 | Bosic | 224/250 |
| 6,427,374 | B1 * | 8/2002 | Vaiani | F41C 23/02 119/770 |
| 7,594,305 | B2 | 9/2009 | Moore | |
| 2009/0120987 | A1 * | 5/2009 | Calayo et al. | 224/660 |
| 2012/0168472 | A1 * | 7/2012 | Mathews | A45F 3/14 224/162 |
| 2012/0181318 | A1 * | 7/2012 | Mongan et al. | 224/665 |
| 2013/0168429 | A1 * | 7/2013 | Pearce | 224/676 |
| 2014/0091116 | A1 * | 4/2014 | Yu | A45F 5/00 224/218 |

* cited by examiner

*Primary Examiner* — Adam Waggenspack
(74) *Attorney, Agent, or Firm* — Hankin Patent Law, APC; Kevin Schraven; Sergio Becerra

(57) ABSTRACT

A radio retention device designed to provide a secure attachment into the back of the majority of portable radios. A clip strap attaches through a belt loop that locks with a clip strap male buckle and a clip strap female buckle. The clip strap is attached to a radio strap which is then attached to a radio male buckle. The radio male buckle snaps into a radio clip which is secured to the back of a radio. A user of the radio retention device can attach the device to the radio and holster providing a secure attachment that will not interfere with the use of the radio. The device can also be embedded into a new holster (FIG. 4) by securing the radio strap directly to the inside of the holster. The security of the device will ensure that the lifeline of communication will not be removed from the professionals that use portable radio systems.

16 Claims, 4 Drawing Sheets

Figure 1:
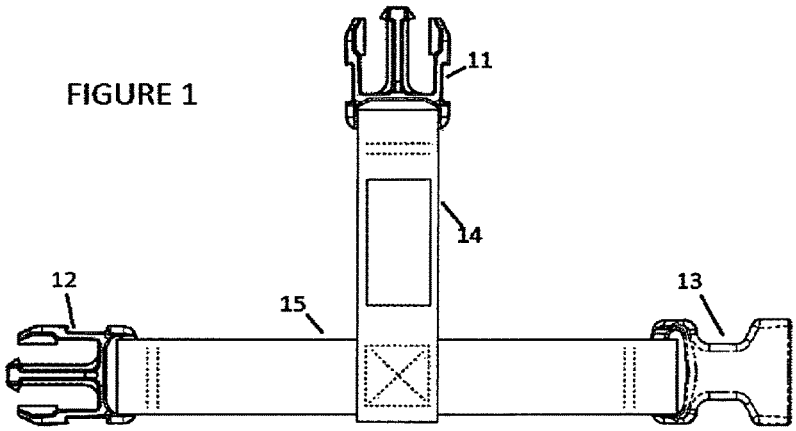

FIGURE 4
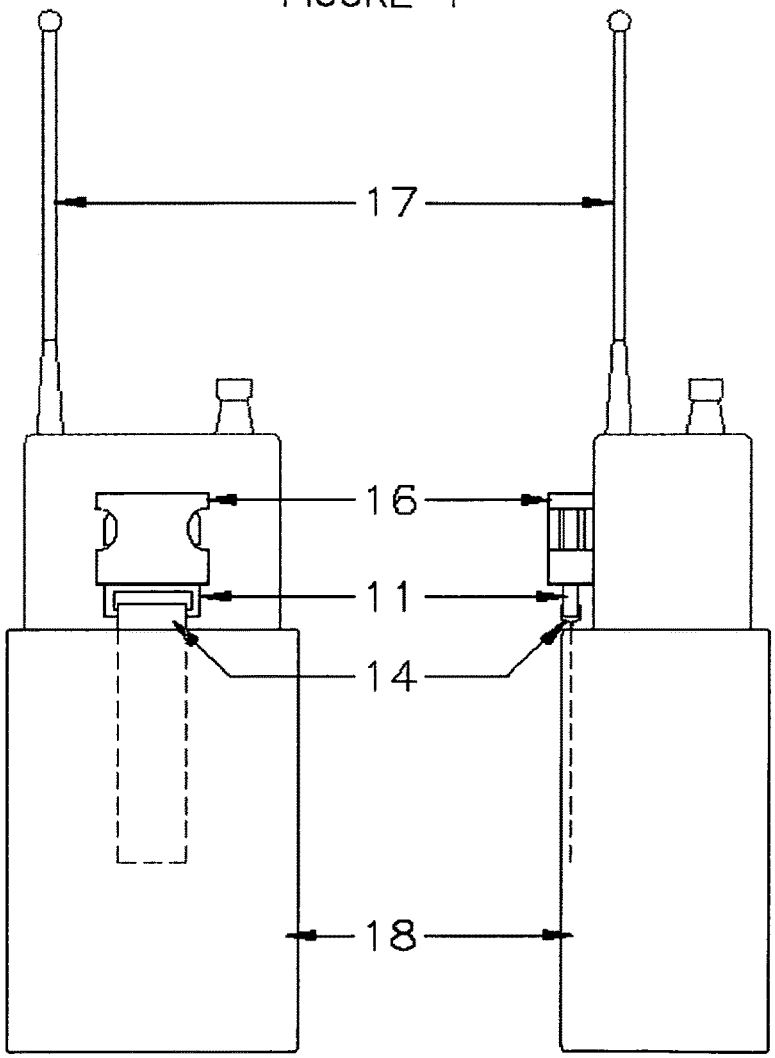
FIGURE 4A
FIGURE 4B
FIGURE 5
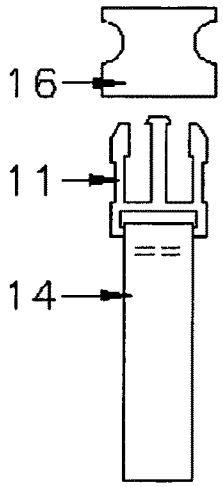

PORTABLE RADIO RETENTION DEVICE

CROSS-REFERENCE TO RELATED APPLICATIONS

None.

FEDERALLY SPONSORED RESEARCH

None.

SEQUENCE LISTING

None.

BACKGROUND

Portable radios are used by many different individuals during the course of their work. They are used by law enforcement, fire departments, military personnel, security officers, rescue personnel, park rangers and a multitude of other professions. In many of these cases, the need for a secure and workable radio is a matter of life and death for the user and for other individuals that they are attempting to protect and serve.

Currently, the security of these radios is unacceptable. Radios can be dislodged by simply bending over or knocking into something. Not to mention the heightened risk for military and law enforcement personnel when they become involved in an altercation. Many criminals have noted that the radio is the life line for law enforcement and military officers. The criminals have in numerous occasions intentionally grabbed the officer's radio and pulled it out of the holster to prevent the officer from calling for backup or summoning assistance. This is a serious safety hazard.

The current radio holsters have an elastic cord that extends over the top of the radio and is secured by a metal snap or a plastic hook. These current wayP4s of securing the radio to the holster are easily defeated and the radio can fall out without anyone even touching the radio.

Both U.S. Pat. No. 7,594,305 proposed by Moore and U.S. Patent Application Number 20120181318 proposed by Mongan show radio retention devices that can be used for portable radios. Both of these patents have significant short comings that will be overcome with the portable radio retention devices described below.

U.S. Pat. No. 7,594,305 attaches the radio by the antenna or electrical socket and U.S. Patent Application Number 20120181318 creates a new holster with a lanyard that attaches around the antenna of the radio. Both the tether and the lanyard could severely damage the radio since the antenna is not designed to bear the weight of the radio. If an altercation occurs, the antenna is also not suitable to bear the weight of someone pulling against it. Damage to the antenna would be just as detrimental to the security of the user as losing the radio out of the holster. The antenna is necessary for radio reception to be achieved and this reception and access to the radio is the user's life line in many situations.

Another disadvantage to U.S. Patent Application Number 20120181318 by Mongan is that it requires the user to buy a completely new holster. The first embodiment can be used with most existing holsters. A second embodiment has the retention device embedded into the holster if the purchase of an entire new holster would be desired.

There is a definite need in the current market for a radio retention device that can securely maintain a radio in a safe and economical manner. In conclusion, insofar as I am aware, no radio retention device exists that will allow the user to secure the radio to the current holster without creating potential damage to the radio or antenna or interference with any radio controls.

SUMMARY

An improved portable radio retention device has a radio clip attached to the protrusion from the battery on the back of the radio. The "clip strap" wraps around the belt loop in the holster where the duty belt feeds through and buckles to attach securely to the holster. The "radio strap" then extends upward and buckles into the radio clip. This allows the user's radio to be secured to the duty belt and holster without any interference of controls.

Accordingly several advantages are to provide an improved radio retention device, to provide an additional layer of safety for portable radio users, and to provide a more economical radio retention device that uses the user's current radio and holster. Further advantages will be seen through the following drawings, description and claims.

DRAWINGS

Figures 2, 2A, 2B, 2C, 2D:
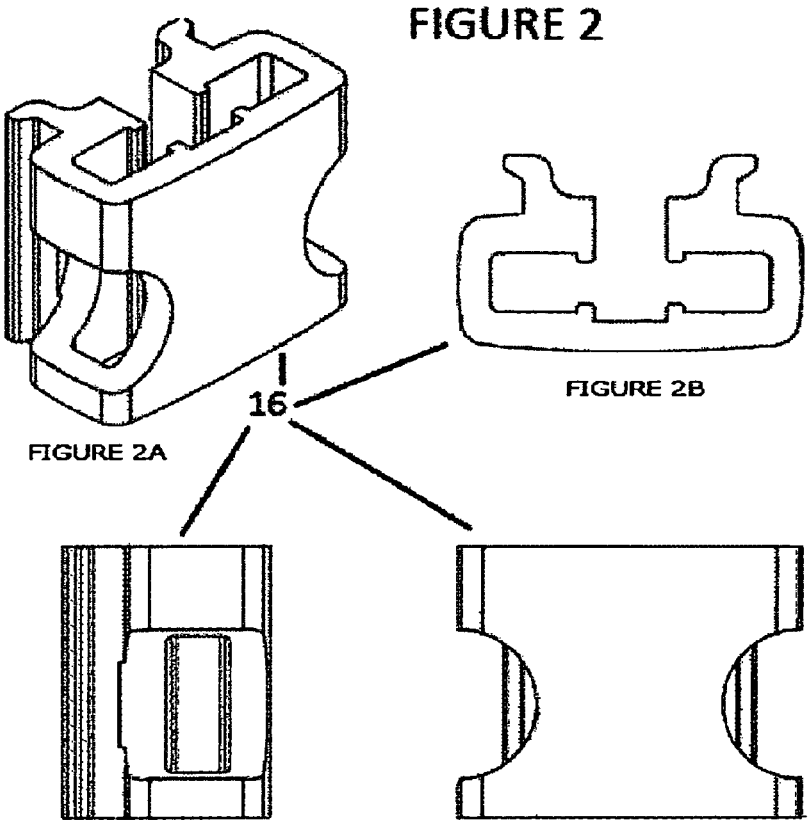
Figures 3, 3A, 3B:
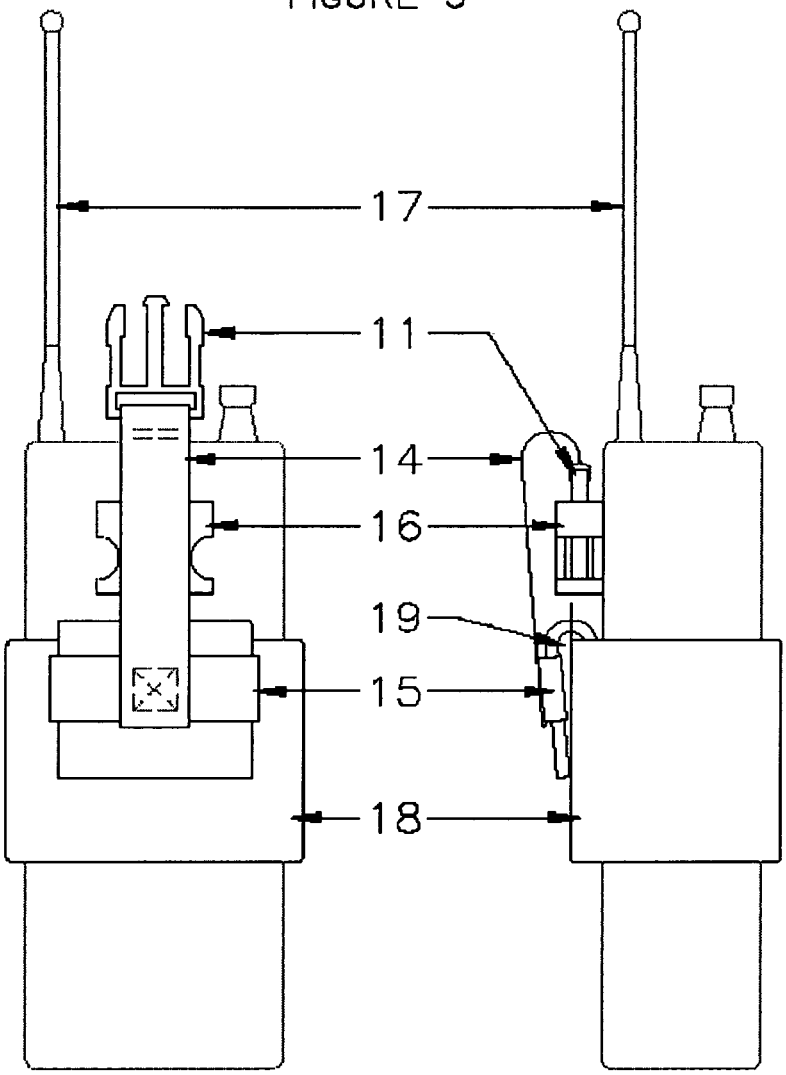

FIG. 1 Radio Retention Device Straps—Plan View
FIG. 2A Radio Clip—Perspective View
FIG. 2B Radio Clip—Top View
FIG. 2C Radio Clip—Right Side View
FIG. 2D Radio Clip—Front Plan View
FIG. 3A Device in use—Back View
FIG. 3B Device in use—Right Side View
FIG. 4A Second Embodiment in use—Back View
FIG. 4B Second Embodiment in use—Right Side View
FIG. 5 Second Embodiment Holster Strap—Plan View

DETAILED DESCRIPTION

FIG. 1 is a top view of the strap portion of the radio retention device while it is laid flat. A clip strap male buckle (12) and a clip strap female buckle (13) slide through a belt loop (19) seen in FIGS. 3A-B and clasp together inside the belt loop to create a secure connection. A clip strap (15) is made of a high-strength material, such as nylon webbing or leather. The clip strap (15) wraps around the back of the holster's belt loop as shown in FIG. 3. A radio strap (14) extends upward from the clip strap (15) and attaches to a radio strap male buckle (11). The radio strap (14) is also made from high-strength material, such as nylon webbing or leather. The radio strap is attached to the clip strap by stitching, rivets, or screws and may be comprised of a single piece of material, rather than two straps joined together. The radio strap male buckle (11) will snap into a radio clip (16) seen in FIG. 2.

FIG. 2 is a view from all sides of the radio clip (16). The radio clip (16) locks into grooves on the back of the radio that are integral to the battery pack. The radio clip (16) will be made out of a high-strength material, such as aluminum or plastic. It will be rigid in nature and will fit securely into the grooves on the back of the radio. The full view and the top view display the prongs which engage the grooves on the back of the radio.

FIGS. 3A-B are views of the entire invention attached to a radio (17) and a holster (18). FIG. 3B displays the clip strap (15) sliding through the belt loop (19) on the holster. Under this belt loop is where the clip strap male buckle (12) and clip strap female buckle (13), clip together, as seen in FIG. 1. FIG. 3B also shows the radio strap (14) extending upward toward the radio clip (16) and locking securely into the radio clip (16). The radio clip (16) is secured to the back of the radio (17) using the existing grooves. FIG. 3A shows the clip strap (15) wrapping around the back of the holster (18). It also displays the way that the radio strap (14) extends along the back of the radio (17) prior to clipping into the radio clip (16).

A second embodiment is shown in FIGS. 4A-B and FIG. 5 as an integral part of a new holster. The radio strap (14) is securely attached to the inside of the holster (18), by means of stitching, rivets or screws. The radio strap (14) extends upward and attaches with a radio strap male buckle (11) to the radio clip (16), which is secured to the back of the radio (17) using the existing grooves.

Operation

In operation one uses the radio (17) and holster (18) in a normal manner. The user can secure the radio (17) into the holster (18) by sliding the clip strap male buckle (12) and clip strap female buckle (13) attached to the clip strap (15) through the belt loop (19) of the holster (18) and attach them by snapping them together (FIGS. 1 and 3). The user then slides the radio clip (16) (FIG. 2) into the grooves on the back of the radio (FIG. 3). To complete the securing process the user snaps the radio strap male buckle (11) attached to the radio strap (14) into the radio clip (16) (FIG. 3). When the device is used to secure the radio (17), the radio (17) cannot be pulled out or accidently removed from the holster (18).

If the user desires to have a completely new holster (18) (FIG. 4), the radio clip (16) (FIG. 2) slides into the grooves in the back of the radio (17) and the radio strap (14) extends upward into the radio clip (16) via the radio strap male buckle (11). The radio strap (14) is securely attached to the new holster (18) and no other buckles or straps are necessary.

We claim:

1. An radio retention device, comprising:

a radio holster a radio clip of rigid material that is configured to attach to a back of a radio;

a radio strap that is threaded through a belt loop of the radio holster;

wherein the radio strap comprises an attachment device on each end;

a clip strap that is configured to reach to a top of the radio clip;

wherein the clip strap comprises a radio clip attachment device that removeably couples with the radio clip; and wherein the radio strap and the clip strap are coupled together such that the radio is secured to the belt loop of the radio holster, such that the radio is secured in the radio holster by the radio strap and the clip strap.

2. The radio retention device of claim 1, wherein said radio clip is constructed of a material selected from the group of materials consisting of metal and plastic.

3. The radio retention device of claim 1, wherein two protrusions on each side of the radio clip extend a length of the radio and attaches in two grooves on the back of the radio.

4. The radio retention device of claim 1, wherein the radio strap is coupled to the clip strap by a coupling device selected from at least one coupling device selected from the group consisting of stitching, rivets, and screws.

5. The radio retention device of claim 4, wherein the radio strap and the clip strap are constructed from a high strength material selected from the group of high strength materials consisting of cotton webbing, nylon webbing, metal cable, molded plastic, and leather.

6. The radio retention device of claim 1, wherein the two attachment devices of the radio strap are one male buckle and one female buckle.

7. The portable radio retention device of claim 6, wherein the radio strap and the clip strap are formed from a unitary piece of material.

8. The portable radio retention device of claim 1, wherein the two attachment devices of the clip strap are buckles.

9. The portable radio retention device of claim 8, wherein the radio clip attachment device locks into the radio clip such that the radio clip attachment device cannot be removed inadvertently.

10. An portable radio retention device, comprising:

a holster configured to contain a radio;

a radio clip attached to a back of the radio;

a radio strap attached on a belt clip or belt loop of said holster; and an attachment device secured to an end of said radio strap which locks into the radio clip for securing the radio into its holder such that the radio cannot be removed unless the attachment device and the radio clip are purposefully uncoupled.

11. The portable radio retention device of claim 10, wherein said radio clip is constructed from a material selected from the group of materials consisting of metal and plastic.

12. The portable radio retention device of claim 10 wherein two protrusions on each side of the radio clip extend a full length of the radio clip and attaches in two grooves on the back of the radio.

13. The portable radio retention device of claim 12, wherein said strap is composed of a high strength material selected from the group of high strength materials consisting of: cotton webbing, nylon webbing, metal cable, molded plastic, and leather.

14. The portable radio retention device of claim 10, wherein the radio strap is attached to said holster by a coupling device selected from at least one coupling device selected from the group consisting of stitching, rivets, and screws.

15. The portable radio retention device of claim 10, wherein the two attachment devices are buckles.

16. The portable radio retention device of claim 15, wherein the radio clip attachment device locks into the radio clip, such that the radio clip attachment device cannot be removed inadvertently.

* * * * *